US005718153A

United States Patent [19]

Borden

[11] Patent Number: 5,718,153

[45] Date of Patent: Feb. 17, 1998

[54] IMPLEMENT TO QUICKLY AND CLEANLY REMOVE A CORK FROM A WINE BOTTLE

[76] Inventor: Brian P. Borden, 4418A Milwaukee St., Madison, Wis. 53714

[21] Appl. No.: 663,331

[22] Filed: Jun. 7, 1996

[51] Int. Cl.[6] ..... B67B 7/04

[52] U.S. Cl. ..... 81/3.45; 81/3.33; 81/63

[58] Field of Search ..... 81/3.33, 3.35, 81/3.37, 3.29, 3.45, 3.2, 61–63, 3.48

[56] References Cited

U.S. PATENT DOCUMENTS

| | | | |
|---|---|---|---|
| 106,036 | 8/1870 | Dickson | 81/3.45 |
| 330,974 | 11/1885 | Friedman et al. | 81/3.45 |
| 561,016 | 5/1896 | Maud | 81/3.45 X |
| 4,572,034 | 2/1986 | Lee | 81/3.45 X |
| 4,765,449 | 8/1988 | Peters | 81/62 X |
| 5,339,711 | 8/1994 | Shu | 81/63 |
| 5,537,899 | 7/1996 | Diedrich | 81/62 X |

FOREIGN PATENT DOCUMENTS

| | | | |
|---|---|---|---|
| 15129 | 11/1886 | United Kingdom | 81/3.45 |
| 19274 | 9/1899 | United Kingdom | 81/3.45 |

*Primary Examiner*—D. S. Meislin

[57] ABSTRACT

An implement to quickly and cleanly remove a cork from a wine bottle comprising a lower cylindrical shaft having an upper end and a lower end with a point. The lower end of the lower shaft has a helical thread extending radially outwardly therefrom in a spiral configuration. An upper cylindrical shaft axially aligns with the lower shaft. The upper shaft is of a shorter extent than the lower shaft. The upper shaft has an upper end with a contoured handle coupled thereto. A first ratchet component is provided and has a cup-shaped cylindrical member with an open upper end and a circular closed lower end coupled at its center to the upper end of the lower shaft. The first ratchet component has inwardly facing teeth. A second ratchet component is provided in a cylindrical configuration with an open upper end and a closed lower end and a side wall formed with an opening. The second ratchet component is positionable within the first ratchet component. A pivotable pawl is secured interiorly of the second ratchet component with outwardly facing teeth engagable with the teeth of the first ratchet component.

2 Claims, 4 Drawing Sheets

IMPLEMENT TO QUICKLY AND CLEANLY REMOVE A CORK FROM A WINE BOTTLE

BACKGROUND OF THE INVENTION

1. Field of the Invention

The present invention relates to an implement to quickly and cleanly remove a cork from a wine bottle and, more particularly, pertains to removing a cork from a wine bottle while the cork remains completely in tact and will not shred to contaminate the wine and the bottle.

2. Description of the Prior Art

The use of cork screws of various designs and configurations are known in the prior art. More specifically, cork screws of various designs and configurations heretofore devised and utilized for the purpose of removing a cork from a bottle through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 5,257,565 to Hung discloses a corkscrew.

U.S. Pat. No. Des. 301,113 to Lapsker discloses a compact combination corkscrew bottle opener.

U.S. Pat. No. 4,446,980 to Oliver et al., dicloses a bottle cork extractor.

U.S. Pat. No. 4,295,392 to Peck discloses a corked bottle opener.

Lastly, U.S. Pat. No. 5,220,855 to Leung et al., discloses a corkscrew.

In this respect, the implement to quickly and cleanly remove a cork from a wine bottle according to the present invention substantially departs from the conventional concepts and designs of the prior art, and in so doing provides an apparatus primarily developed for the purpose of removing a cork from a wine bottle while the cork remains completely in tact and will not shred to contaminate the wine and the bottle.

Therefore, it can be appreciated that there exists a continuing need for new and improved implement to quickly and cleanly remove a cork from a wine bottle which can be used for removing a cork from a wine bottle while the cork remains completely in tact and will not shred to contaminate the wine and the bottle. In this regard, the present invention substantially fulfills this need.

SUMMARY OF THE INVENTION

In view of the foregoing disadvantages inherent in the known types of cork screws of various designs and configurations now present in the prior art, the present invention provides an improved implement to quickly and cleanly remove a cork from a wine bottle. As such, the general purpose of the present invention, which will be described subsequently in greater detail, is to provide a new and improved implement to quickly and cleanly remove a cork from a wine bottle apparatus and method which has all the advantages of the prior art and none of the disadvantages.

To attain this, the present invention essentially comprises an implement to quickly and cleanly remove a cork from a wine bottle comprising a lower cylindrical shaft having an upper end and a lower end with a point. The lower end of the lower shaft has a helical thread extending radially outwardly therefrom in a spiral configuration. An upper cylindrical shaft axially aligns with the lower shaft. The upper shaft is of a shorter extent than the lower shaft. The upper shaft has an upper end with a contoured handle coupled thereto. A first ratchet component is provided and has a cup-shaped cylindrical member with an open upper end and a circular closed lower end coupled at its center to the upper end of the lower shaft. The first ratchet component has inwardly facing teeth. A plate in a cylindrical configuration extends radially outwardly from a central extent of the lower shaft with cork engaging points extending downwardly therefrom for engagement with the cork to be removed from a bottle. A second ratchet component is provided in a cylindrical configuration with an open upper end and a closed lower end and a side wall formed with an opening. The second ratchet component is positionable within the first ratchet component. A pivotable pawl is secured interiorly of the second ratchet component with outwardly facing teeth engagable with the teeth of the first ratchet component.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved implement to quickly and cleanly remove a cork from a wine bottle which has all the advantages of the prior art cork screws of various designs and configurations and none of the disadvantages.

It is another object of the present invention to provide a new and improved implement to quickly and cleanly remove a cork from a wine bottle which may be easily and efficiently manufactured and marketed.

It is a further object of the present invention to provide a new and improved implement to quickly and cleanly remove a cork from a wine bottle which is of a durable and reliable construction.

An even further object of the present invention is to provide a new and improved implement to quickly and cleanly remove a cork from a wine bottle which is susceptible of a low cost of manufacture with regard to both materials and labor, and which accordingly is then susceptible of low prices of sale to the consuming public, thereby making such cork screws of various designs and configurations economically available to the buying public.

Still yet another object of the present invention is to provide a new and improved implement to quickly and cleanly remove a cork from a wine bottle which provides in the apparatuses and methods of the prior art some of the advantages thereof, while simultaneously overcoming some of the disadvantages normally associated therewith.

Still another object of the present invention is to remove a cork from a wine bottle while the cork remains completely in tact and will not shred to contaminate the wine and the bottle.

Lastly, it is an object of the present invention to provide a new and improved implement to quickly and cleanly remove a cork from a wine bottle comprising a lower cylindrical shaft having an upper end and a lower end with a point. The lower end of the lower shaft has a helical thread extending radially outwardly therefrom in a spiral configuration. An upper cylindrical shaft axially aligns with the lower shaft. The upper shaft is of a shorter extent than the lower shaft. The upper shaft has an upper end with a contoured handle coupled thereto. A first ratchet component is provided and has a cup-shaped cylindrical member with an open upper end and a circular closed lower end coupled at its center to the upper end of the lower shaft. The first ratchet component has inwardly facing teeth. A second ratchet component is provided in a cylindrical configuration with an open upper end and a closed lower end and a side wall formed with an opening. The second ratchet component is positionable within the first ratchet component. A pivotable pawl is secured interiorly of the second ratchet component with outwardly facing teeth engagable with the teeth of the first ratchet component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
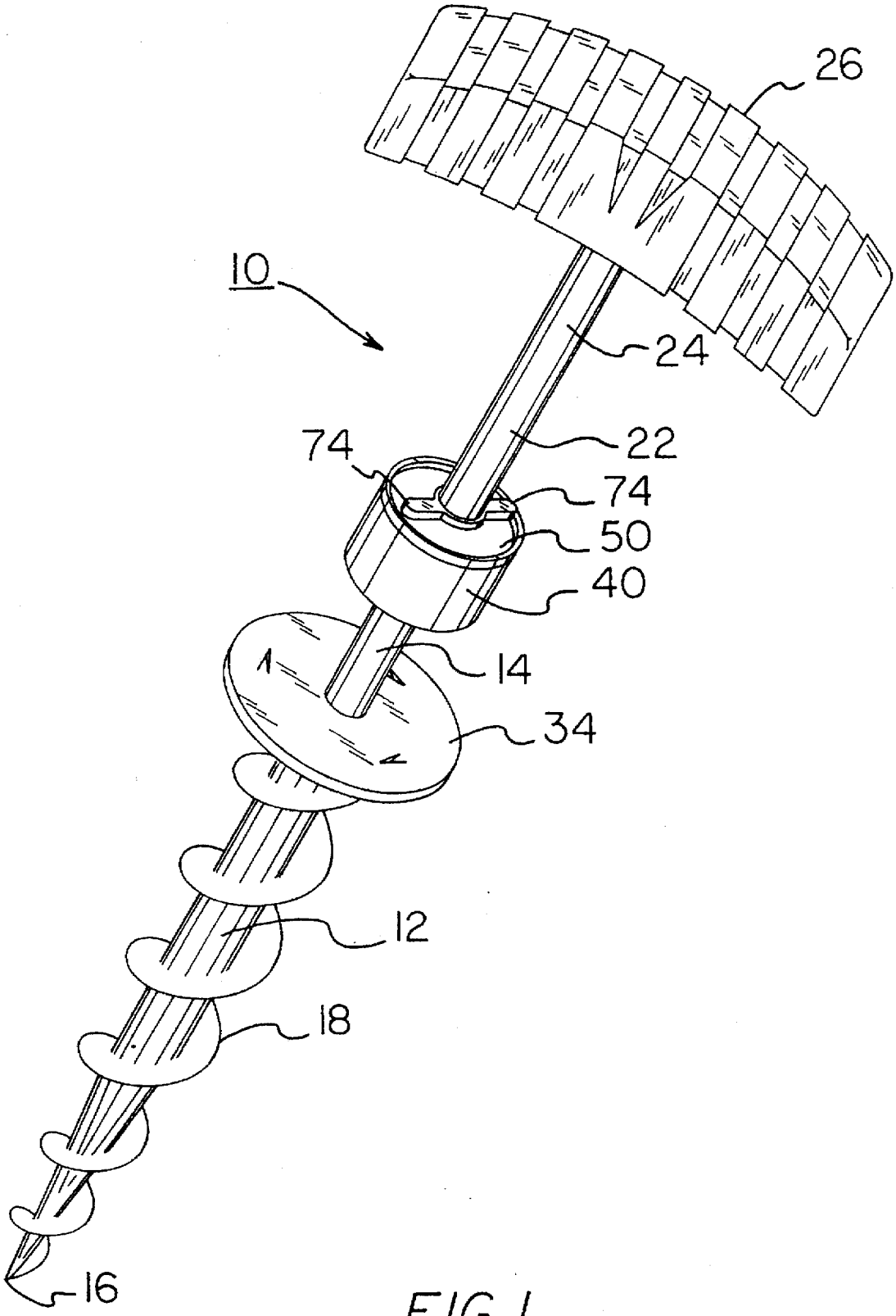
FIG. 1 is a perspective illustration of the preferred embodiment of the implement to quickly and cleanly remove a cork from a wine bottle constructed in accordance with the principles of the present invention.
Figure 2:
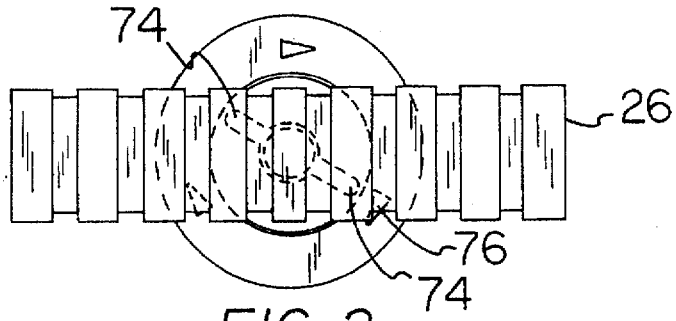
FIG. 2 is a top plan view of the device shown in FIG. 1.
Figure 3:
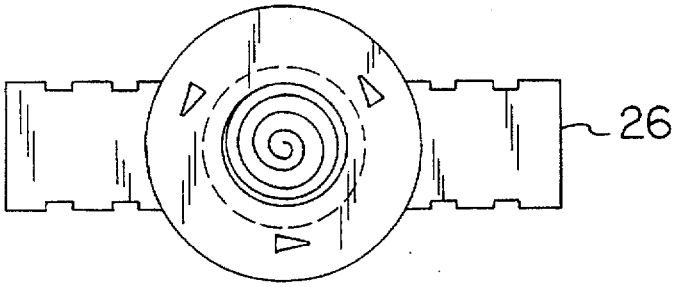
FIG. 3 is a bottom plan view of the device shown in FIG. 1.

With reference now to the drawings, and in particular to FIG. 1 thereof, a new and improved implement to quickly and cleanly remove a cork from a wine bottle embodying the principles and concepts of the present invention and generally designated by the reference numeral 10 will be described.

The present invention, the new and improved implement to quickly and cleanly remove a cork from a wine bottle, is comprised of a plurality of components. Such components in their broadest context include an upper shaft, a lower shaft, a first ratchet, a second ratchet and a pawl. Such components are individually configured and correlated with respect to each other so as to attain the desired objective.

Figure 4:
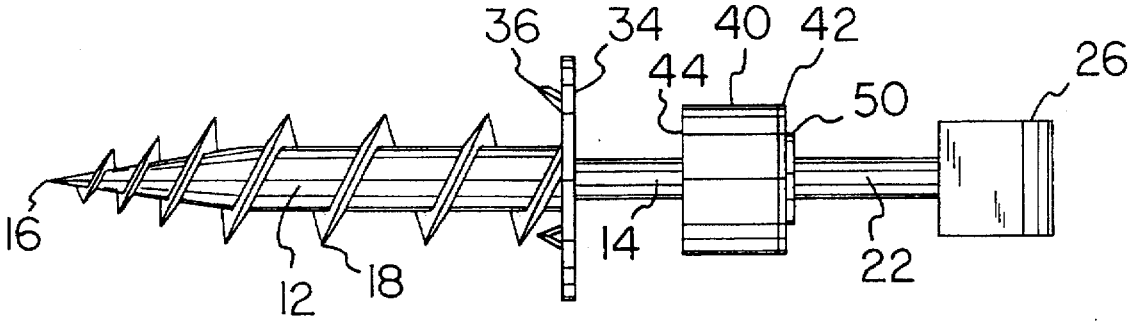
FIG. 4 is a side elevational view of the device shown in FIG. 1.
Figure 5:
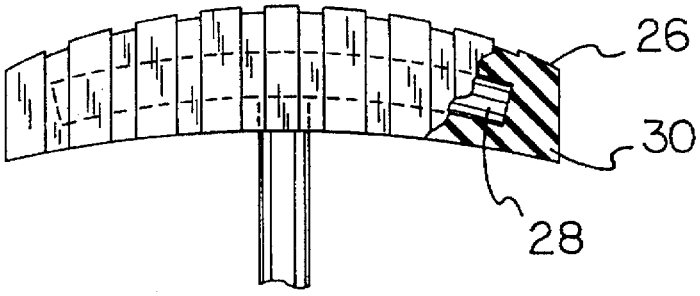
FIG. 5 is an enlarged front elevational view of the handle with parts broken away to show certain internal constructions thereof.
Figure 6:
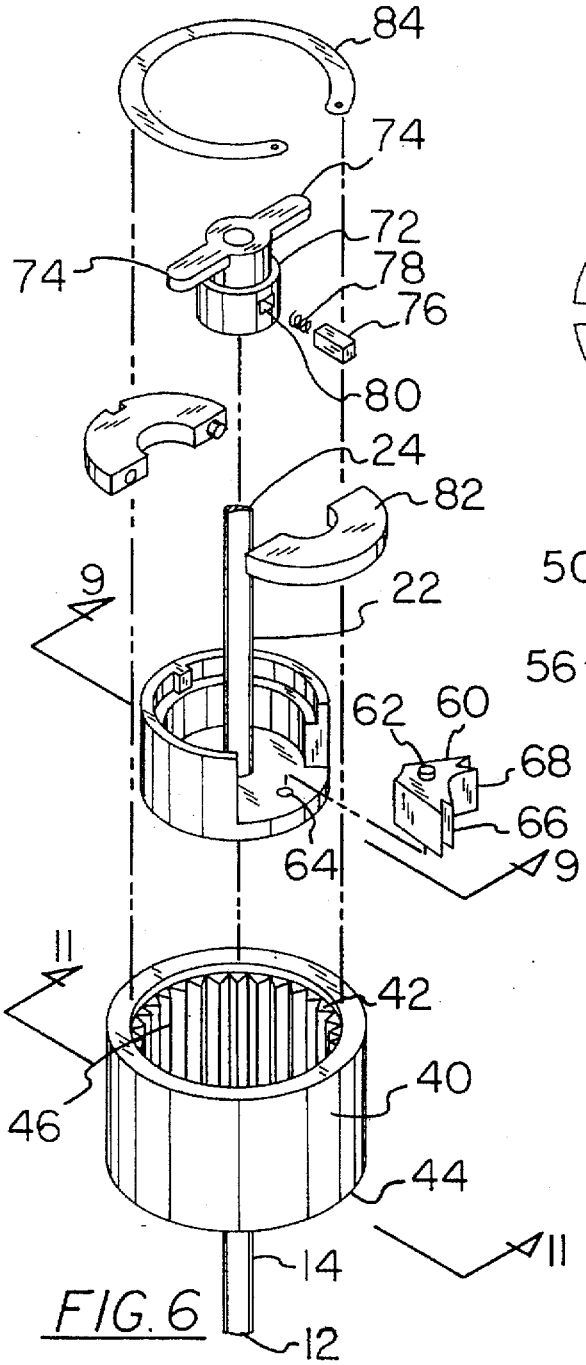
FIG. 6 is an exploded perspective view of the components of the upper portion of the device shown in FIG. 1.
Figure 7:
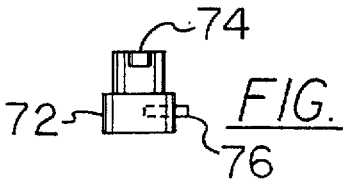
FIG. 7 is a side elevational view of one of the components shown in FIG. 6.
Figure 8:
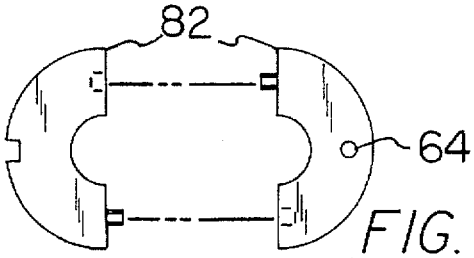
FIG. 8 is a top elevational view of an other of the components shown in FIG. 6.
Figure 9:
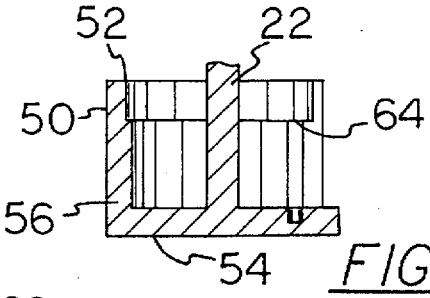
FIG. 9 is a cross sectional view taken along line 9—9 of FIG. 1.
Figure 10:
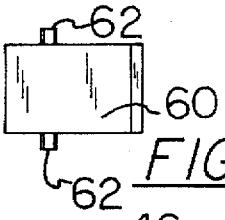
FIG. 10 is a side elevational view of the one of the components shown in FIG. 6.
Figure 11:
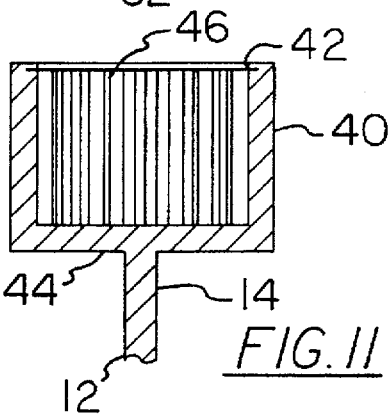
FIG. 11 is a cross sectional view taken along line 11—11 of FIG. 6.

More specifically, the present component of the system 10 is a lower cylindrical shaft 12. Such shaft has an upper end 14 and a lower end 16 with a point. The lower end of the lower shaft has a helical thread 18 extending radially outward therefrom. Such thread is in a spiral configuration. Note FIGS. 1 and 4.

The system 10 also includes an upper cylindrical shaft 22. Such upper shaft is axially aligned with the lower shaft. The upper shaft is of a shorter length than the length of the lower shaft. The upper shaft has an upper end 24 with contoured handle 26 secured thereto. Such handle preferably has a rigid interior component 28 and an exterior grasping component 30 of a softer elastomeric material for comfort.

Next provided is a plate 34. The plate is in a cylindrical configuration. It extends radially outwardly from a central extent of the lower shaft. It is formed with planar triangular shaped cork engaging teeth 36 which extend from the lower surface of the plate in an angled oreintation. The teeth are angled in the direction of rotation of the lower cylindrical shaft so that upon rotation the teeth function to engage and grip a cork thereby facilitating removal.

Intermediate the upper and lower shafts is a first ratchet component 40. Such first ratchet component has a cup-shaped cylindrical member. Such member has an open upper end 42. It also has a circular closed lower end 44. The closed lower end is coupled at its center to the upper end of the lower shaft. Such first ratchet component has inwardly facing teeth 46 therearound.

In association with the first ratchet component is a second ratchet component 50. The second ratchet component is also in a cylindrical configuration. It is formed with an open upper end 52. It is also formed with a closed lower end 54.

A side wall 56 is formed to have an opening over a minor extent thereof, preferably about 45 degrees. The second ratchet component is positionable within the first ratchet component.

Next provided is a pivotable pawl 60. Such pawl is secured about pins 62 in recesses 64 of the adjacent components thereabove and therebelow. Such ratchet component is formed with outwardly facing teeth 66, 68. Such teeth are selectively engageable with the teeth of the first ratchet component and are used for turning one ratchet component with respect to the other during the removal of a cork from a bottle or from the implement from the cork.

Figure 13:
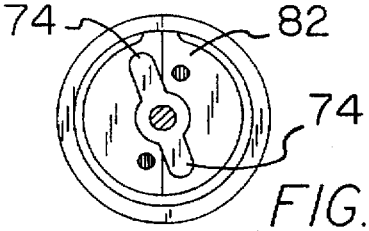
FIG. 13 is a top plan view similar to FIG. 12 but shown in an alternate orientation.
Figure 12:
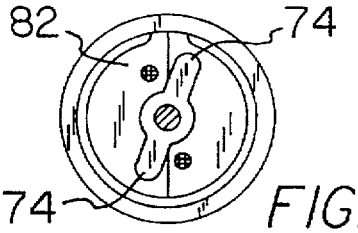
FIG. 12 is a top elevational view of the device shown in FIGS. 1, 2, 4 and 6.

Lastly provided is a rotatable interior locking assembly 72. Such locking assembly has rotatable legs 74 at its upper extent. It also has an axially reciprocable finger 76 in its lower extent. Such finger is urged outwardly by an associated spring 78 located within a recess 80 of the lock assembly. In addition, mating semicircular plates 82 are used to secure the reciprocable finger within the ratchet component. A resilient C-shaped keeper 84 maintains the plates in position within the second ratchet component. In this manner, rotation of the legs in a first direction as shown in FIG. 12 will rotate the finger whereby one tooth will allow rotation of the threads in a first direction. Rotation of the legs in a second or opposite direction as shown in FIG. 13 will rotate the finger to a second orientation adjacent the pawl to allow removal of the threads of the implement from a cork.

Figure 14:
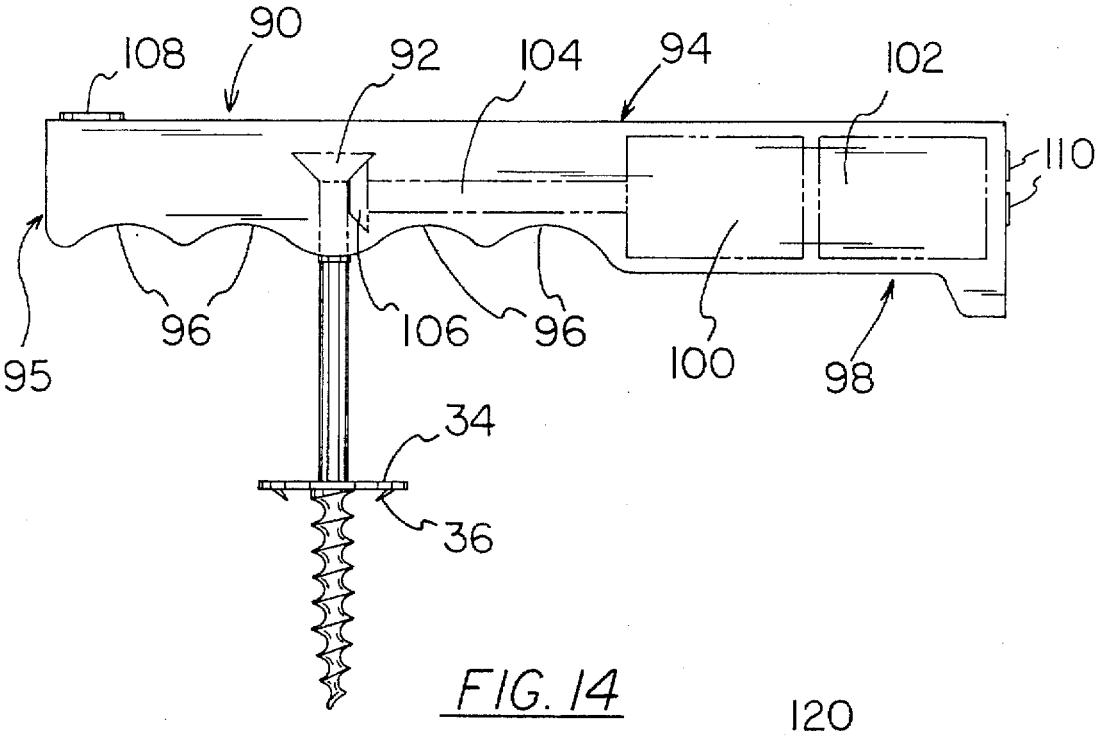
FIG. 14 is a first alternative embodiment illustrating a motorized version of the apparatus.

A first alternate embodiment 90 of the apparatus is shown in FIG. 14. In such embodiment, the upper exent of the upper cylindrical shaft includes a gear head 92. Also, the handle 94 is formed in an elongated generally cylindrical configuration with a gripping region 95 and a base region 98. The gripping region includes a plurality of finger indentations 96. The gear head 92 of the upper cylindrical shaft is rotatably positioned within the gripping region. The base region includes a motor 100 and a rechargeable battery 102 operatively coupled to it. The motor includes a drive shaft 104 with a gear head 106 positioned in engaging contact with the gear head 92 of the upper cylindrical shaft. The handle includes a start button 108 and two external battery terminals 110. In a further alternate embodiment the apparatus includes a recharger base which permits vertical receipt of the base region of the handle when recharging is required. Note FIG. 14.

Figure 15:
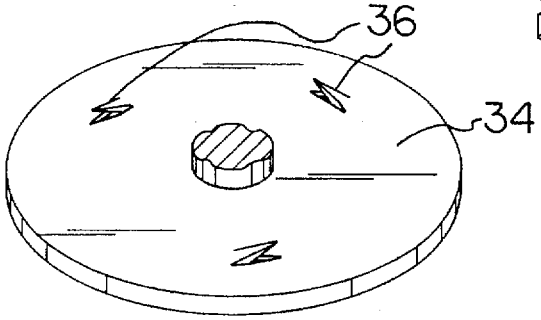
FIG. 15 is an isolated perspective view of the lower surface of the plate shown in FIG. 14.

As in the primary embodiment of the apparatus, a circular plate 34 is affixed above the helical threads of the lower cylindrical shaft. The plate includes planar triangular cork engaging teeth 36 which are angled from the lower surface of the plate. In an operative orientation a user depresses the start button thereby causing rotation of the gear heads and shaft to permit removal of a cork from a wine bottle. Note FIGS. 14 and 15.

Figure 16:
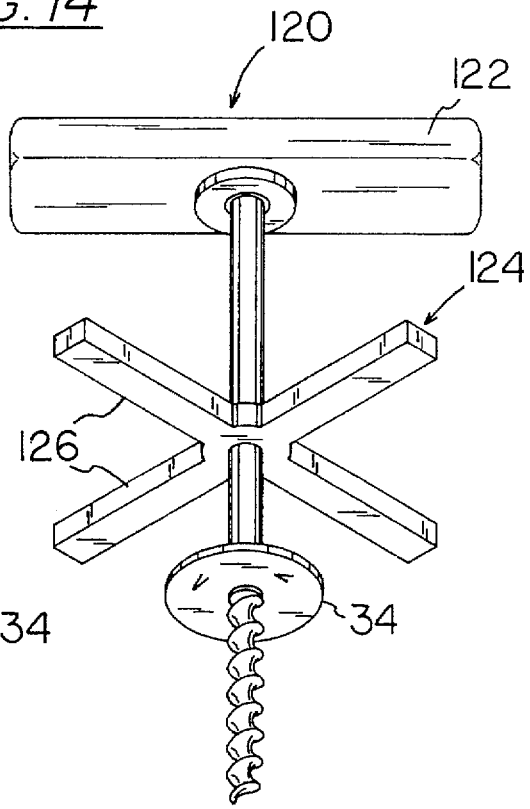
FIG. 16 is a second alternative embodiment illustrating the secondary crossbar of the apparatus.

A second alternate embodiment 120 of the apparatus is shown in FIG. 16. In such embodiment, the handle 122 is formed in an elongated generally rectangular configuration. Also, a cross bar 124 is affixed to the upper cylindrical shaft. The cross bar includes four arm members 126 which extend radially from the upper cylindrical shaft at about ninety degree angles with respect to each other. The cross bar 124 provides a stationary grasping handle to secure the cylindrical shaft while removing the cork from the implement. Note FIG. 16.

The present invention is an implement which quickly and cleanly removes the cork from a wine bottle While the cork remains completely intact and will not shred to contaminate the wine in the bottle.

It is a T-shaped tool with a curved and contoured handle. This handle is rubber coated and has a series of transverse grooves for positive gripping. A stainless steel shaft extends from the concave side of the handle and a disc-like stop plate which is slightly smaller than a cork is formed at its approximate midpoint. This stop plate has three small barbs which are equally spaced on its lower face. The remainder of the shaft is a corkscrew.

From the foregoing description, the use of this handy and functional implement becomes fairly obvious. As one turns the corkscrew into the cork, the stop plate will abut the top of the cork and penetration of the corkscrew will be stopped while the cork is impaled upon the barbs. Further turning will then result in rotation of the cork within the bottle, and a gentle upward pull will cleanly dislodge the cork.

The idea is simple but very effective, and one will not be obliged to struggle with the elaborate and large levered version which requires two hands to operate and is popularly used by most. The straighter corkscrew also facilitates better vision and precise central alignment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved implement to quickly and clearly remove a cork from a wine bottle while the cork remains completely in tact and will not shred to contaminate the wine and the bottle comprising, in combination:

a lower cylindrical shaft having an upper end and a lower end with a point, the lower end of the lower shaft having a helical thread extending radially outwardly therefrom in a sprial configuration;

an upper cylindrical shaft axially aligned with the lower shaft, the upper shaft being of a shorter extent than the lower shaft, the upper shaft having an upper end with a contoured handle coupled thereto;

a plate in a cylindrical configuration extending radially outwardly from the lower shaft intermediate the upper end and lower end of the lower shaft, with cork engaging points extending downwardly therefrom for engagement with the cork to be removed from a bottle;

a first ratchet component having a cup-shaped cylindrical member with an open upper end and a circular closed lower end coupled at the center to the upper end of the lower shaft, the first ratchet component having inwardly facing teeth;

a second ratchet component in a cylindrical configuration with an open upper end and a closed lower end and a side wall formed with an opening, the second ratchet component being positionable within the first ratchet component;

a pivotable pawl secured interiorly of the second ratchet component with outwardly facing teeth engagable with the teeth of the first ratchet component; and a rotatable interior lock assembly with rotatable legs at its upper extent and an axially reciprocable finger in its lower extent with mating semicircular plates to secure the reciprocable finger within the upper ratchet component whereby rotation of the legs in a first direction will rotate the finger to allow rotation in a first direction while rotation of the legs in a second direction will rotate the finger in a second direction.

2. An implement to quickly and cleanly remove a cork from a wine bottle comprising:

a lower cylindrical shaft having an upper end and a lower end with a point, the lower end of the lower shaft having a helical thread extending radially outwardly therefrom in a spiral configuration;

an upper cylindrical shaft axially aligned with the lower shaft, the upper shaft having art upper end with a contoured handle coupled thereto; and a plate formed in a cylindrical configuration and extending radially outwardly from the lower shaft intermediate the upper end and lower end of the lower shaft with cork points extending downwardly therefrom for engagement with the cork to be removed from a bottle;

a first ratchet component having a cup-shaped cylindrical member with an open upper end and a circular closed lower end coupled at its center to the upper end of the lower shaft, the first ratchet component having inwardly facing teeth;

a second ratchet component in a cylindrical configuration with an open upper end and a closed lower end and a side wall formed with an opening, the second ratchet component being positionable within the first ratchet component; and a pivotable pawl secured interiorly of the second ratchet component with outwardly facing teeth engagable with the teeth of the first ratchet component; and including a rotatable interior lock assembly with rotatable legs at its upper extent and an axially reciproacable finger in its lower extent with mating semicircular plates to secure the reciprocable finger within the upper ratchet component whereby rotation of the legs in a first direction will rotate the finger to allow rotation in a first direction while rotation of the legs in second direction will rotate the finger in a second direction.

* * * * *